US009408439B2

(12) United States Patent
Barce et al.

(10) Patent No.: US 9,408,439 B2
(45) Date of Patent: Aug. 9, 2016

(54) INTERCHANGEABLE DECORATIVE COVER FOR BUTTONS

(71) Applicants: Susan Michelle Barce, Burke, VA (US); Keith M Nystrom, Burke, VA (US)

(72) Inventors: Susan Michelle Barce, Burke, VA (US); Keith M Nystrom, Burke, VA (US)

( * ) Notice: Subject to any disclaimer, the term of this patent is extended or adjusted under 35 U.S.C. 154(b) by 81 days.

(21) Appl. No.: 13/605,165

(22) Filed: Oct. 24, 2012

(65) Prior Publication Data

US 2014/0109346 A1 Apr. 24, 2014

(51) Int. Cl.
*A44B 1/04* (2006.01)
*A44B 1/14* (2006.01)

(52) U.S. Cl.
CPC ... *A44B 1/04* (2013.01); *A44B 1/14* (2013.01); *Y10T 24/367* (2015.01); *Y10T 24/3694* (2015.01)

(58) Field of Classification Search
CPC ..... A44B 1/04; A44B 1/14; Y10T 24/3694; Y10T 24/367; Y10T 24/3672
USPC ..... 24/113 R, 113 MP, 114.9, 94, 95, 114.2; 215/356, 355; 220/288, 293, 297
See application file for complete search history.

(56) References Cited

U.S. PATENT DOCUMENTS 1,744,350 A * 1/1930 White et al. ..... 24/95
1,821,615 A * 9/1931 Carley et al. ..... 24/95
2,067,222 A * 1/1937 Wolff ..... 40/315
2,067,223 A * 1/1937 Janes ..... 40/315
2,067,224 A * 1/1937 Huckins ..... 40/315
2,179,032 A * 11/1939 Carley et al. ..... 24/95
3,141,211 A * 7/1964 Blake ..... 24/114.9
4,158,251 A * 6/1979 Howell ..... A44B 1/04 24/113 MP
4,788,753 A * 12/1988 Sparrow et al. ..... 24/113 MP
4,941,234 A * 7/1990 Watanabe et al. ..... 24/113 MP
5,513,422 A * 5/1996 Wen-Lung ..... 24/92
5,517,730 A * 5/1996 Ho ..... 24/92
5,526,551 A * 6/1996 Herman ..... 24/113 MP
5,542,157 A * 8/1996 Herman ..... 24/113 MP
5,575,043 A * 11/1996 Candotti ..... 24/114.4
5,644,820 A * 7/1997 Ho ..... 24/92
6,266,853 B1 * 7/2001 Ho ..... 24/92
6,457,213 B2 * 10/2002 Watanabe ..... 24/94
7,251,865 B2 * 8/2007 Takamura et al. ..... 24/114.4
2009/0217490 A1 * 9/2009 Lu ..... 24/114.9
2010/0236028 A1 * 9/2010 Clark ..... 24/113 R
2011/0000052 A1 * 1/2011 Suter ..... A44B 1/08 24/113 R

* cited by examiner

*Primary Examiner* — Abigail Morrell
(74) *Attorney, Agent, or Firm* — Dennis H. Lambert

(57) ABSTRACT

A decorative cover for interchangeable attachment to buttons to change the appearance of the button. The decorative cover includes a base member with a hollow bore extending through at least one end thereof, and a decorative part permanently attached to an opposite end. An inner surface of the bore frictionally engages an outer edge of the button to retain the base member in place but permit it to be removed when desired. In one embodiment the base member is an elastomeric material having a durometer to enable the button to press into an inner surface of the bore. A detent may be provided in the bore to engage the button to assist in holding the decorative cover in place. In another embodiment the base member is longitudinally split into two semi-cylindrical segments that spread apart to enable a button to be engaged between them.

7 Claims, 5 Drawing Sheets

INTERCHANGEABLE DECORATIVE COVER FOR BUTTONS

This application claims the benefit of U.S. provisional patent application Ser. No. 61/534,811, filed Sep. 14, 2011.

TECHNICAL FIELD

This invention relates to fashion accessories, and in particular to interchangeable decorative covers that may be selectively applied to and removed from buttons, snaps, studs and the like to display a particular theme or to produce a desired fashion accessory.

BACKGROUND ART

Buttons used for displaying patriotic, political, sports, or other themes typically comprise separate items that are attached to clothing by pins, clips, studs, or the like, and are not used as covers for pre-existing buttons that are sewn on.

Children, for example, generally have favorite sports and/or favorite heroes or characters, but their preference for and display of these favorites is typically limited to use of separate pin-on buttons, or on banners, posters, backpacks, and the like.

Moreover, sewn-on buttons generally impart a certain decorative function or fashion theme to the item of clothing to which they are attached. For example, buttons can have a more formal or less formal appearance, and thus impart a more formal or less formal appearance to the item of clothing to which they are attached. However, they are fixed in appearance once sewn onto the clothing. Thus, for example, a blouse might be fashionably appropriate for use with certain accessories or for wear on certain occasions depending upon the buttons that are sewn onto the blouse. If a different look, e.g. a more formal appearance or less formal appearance or use with different accessories is desired, a different blouse with different buttons typically must be chosen.

Decorative covers for pre-existing sewn-on buttons are known, as exemplified for example in U.S. Pat. Nos. 2,983,975, 3,500,507 and 7,350,274.

U.S. Pat. No. 2,983,975 discloses a decorative overlay that can be secured to a button to match a button with other accessories. The overlay is secured to the button by the use of adhesive.

U.S. Pat. No. 3,500,507 discloses a decorative overlay that is secured to a button by the use of a spring clip.

U.S. Pat. No. 7,350,274 discloses an accessory device that can be removably attached to the button of a hat. The device can include a base unit and a decorative unit that are integrally formed or formed as separate pieces snapped together. In that form wherein the base unit and decorative unit are integrally formed as one piece, the device is frictionally retained on the button. This patent discloses the device as being made of PVC or polyethylene.

Prior art covers for buttons are either too complex or expensive in construction, or are made of materials that are too hard to achieve a secure grip on a button unless the button is covered with a fabric.

It would be desirable to have an interchangeable decorative or thematic cover for removable application to buttons, snaps, studs and the like wherein the cover is simple and inexpensive in construction and is made for secure frictional attachment to conventional buttons, snaps, studs and the like whether the buttons and the like are made of metal, plastic, wood or other material.

SUMMARY OF THE INVENTION

The present invention provides a decorative or thematic cover for removable and interchangeable application to buttons, snaps, studs and the like wherein the cover is simple and inexpensive in construction and is made for simple and secure attachment to conventional metal, plastic or wooden buttons, snaps, studs and the like. As used hereinafter, the term "button" is intended to include snaps, studs, and the like.

The cover of the invention comprises a decorative part permanently adhesively attached to a base member. The base member has a hollow bore with a diameter slightly smaller than the diameter of the button to which it is to be attached, and has a tight fit on the button to prevent its inadvertent removal but permit it to be pressed onto and removed from a button. In preferred embodiments the base member is made of an elastomeric material that deforms or stretches to receive the button. Detents may be provided in the hollow bore of the base member to enhance secure attachment to a button. In a preferred construction the elastomeric material comprises Buna N rubber with a durometer of 55 to 65 Shore A, although it could be made of other materials, such as silicone, for example, having the appropriate durometer.

In an alternate construction the base member can be made of a plastic material and slotted on at least one side so that it can yield or spread apart to enable it to be pressed onto a button. In this version a detent is preferably formed in the hollow bore to help retain the base member on the button.

The base member may be colored, opaque, translucent, or transparent, as desired.

In one form of the invention the base member is an open-ended cylinder with the bore extending completely therethrough. In another form it is generally cup-shaped with the bore extending through the open end of the cup, and in yet another form it is circular in plan view and generally T-shaped in longitudinal cross-section, with the bore extending through the leg of the T and terminating at the head of the T. In either event, when the decorative part is attached to the base member the bore is open only at the end that goes over the button. If desired, suitable indicia to indicate a series number or some other desired message may be placed in the blind end of the bore. In that form where the bore extends completely through the base member, the indicia can be easily applied to the underside of the decorative cover before it is applied to the base member.

The decorative covers according to the invention can have any desired graphics or theme and can be more formal or less formal in appearance. They can be used to impart a different look to a shirt or blouse, enabling a single garment to be quickly and easily converted from a less formal look to a more formal look, and vice versa. Thus, for example, a blouse might be fashionably appropriate for use with certain accessories or for wear on certain occasions depending upon the buttons that are sewn onto the blouse. If a different look, e.g. a more formal appearance or use with different accessories is desired, a different blouse with different buttons typically must be chosen. The present invention enables the appearance of a single garment to be altered to suit a desired occasion or result.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAILED DESCRIPTION OF THE PREFERRED EMBODIMENTS

Figure 1:
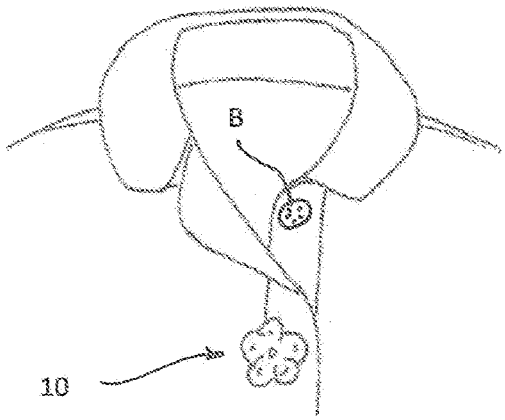
FIG. 1 is a fragmentary front view of a shirt, showing one conventional uncovered button and a decorative cover according to a first embodiment of the invention applied to another button.
Figure 2:
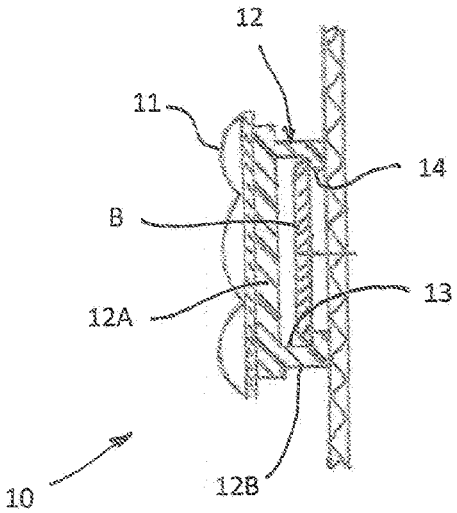
FIG. 2 is a sectional view of the decorative cover of FIG. 1.
Figure 3:
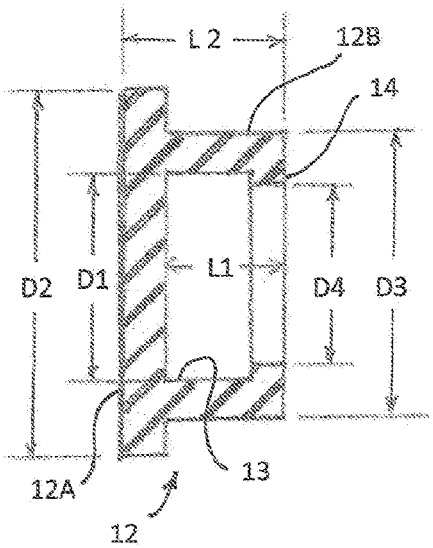
FIG. 3 is an enlarged sectional view of the base member of FIGS. 1 and 2, shown without the decorative cover.

A first preferred embodiment of the invention is indicated generally at 10 in FIGS. 1-3, and comprises a decorative member 11 secured to a base member 12. In this embodiment the base member is generally T-shaped in longitudinal section, with a disc-shaped end wall 12A and a cylindrically shaped leg 12B. A central bore 13 extends through the leg and terminates at the end wall. An inturned lip 14 is in the open end of the leg 12B to enhance the grip of the base member on a button.

In a preferred construction the decorative member is adhesively secured to the base member, and the base member is made of an elastomeric material preferably having a durometer of 55 to 65 Shore A. One suitable material is Buna N rubber. The bore has a length L1 adapted to fully receive a button B therein with some clearance between the button and the closed end of the bore, and a diameter D1 slightly less than the diameter of the button to which the decorative cover is to be attached so that the button will be snugly engaged in the bore. Although the button is tightly frictionally engaged in the bore of the base member, the inturned lip 14 engages behind the button and provides extra assurance that the decorative cover will not be inadvertently displaced from the button.

In a specific example of this form of the invention the base member has an overall length L2 of about ¼ inch and an outside diameter D2 of about ¾ of an inch at the disc-shaped end wall 12A. The diameter D1 of the bore is approximately ⅜ inch, the outer diameter D3 of the leg 12B is slightly more than ½ inch, and the lip 14 has an inner diameter D4 of slightly more than 5/16 of an inch. These dimensions are exemplary of a workable size that fits most common buttons but it should be understood that other sizes could be adapted to different size buttons and studs.

Figure 4:
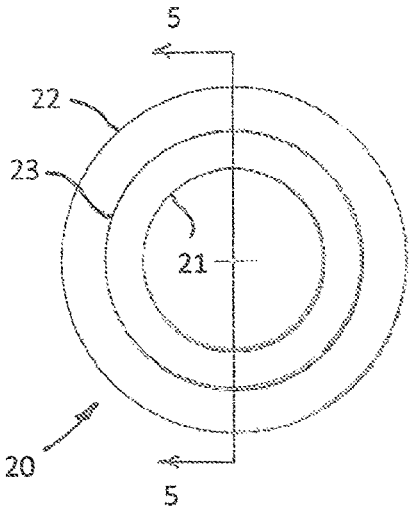
FIG. 4 is an end view in elevation of a second embodiment of the base member according to the invention, looking toward the back end or end of the base member that receives the button, and wherein an open bore extends completely through the base member.
Figure 5:
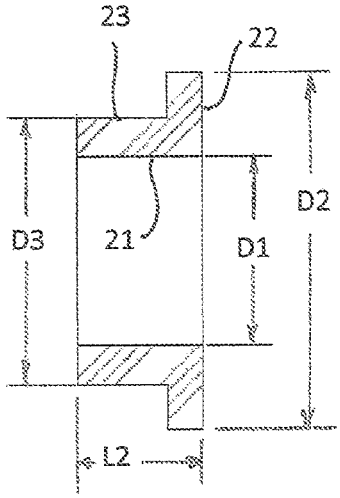
FIG. 5 is a longitudinal sectional view taken along line 5-5 in FIG. 4.

A second embodiment of the invention is indicated generally at 20 in FIGS. 4 and 5. This form of the invention is generally the same as that form of the invention shown in FIGS. 1, 2 and 3 except that the bore 21 extends completely through the base member, whereby a radially outwardly extending flange 22 is on the outer end of the base member rather than a disc-shaped end wall as in the previous embodiment. Also, the lip on the inner end of the cylindrical wall 23 is omitted and the bore 21 has a smooth surface throughout its length. Otherwise, the materials and dimensions are essentially the same as in the previous embodiment.

Figure 6:
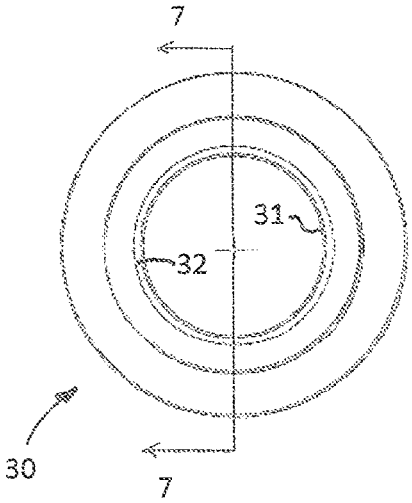
FIG. 6 is an end view in elevation of a third embodiment of the base member according to the invention, looking toward the back end of the base member, and wherein a detent is provided in the hollow bore spaced from its opposite ends.
Figure 7:
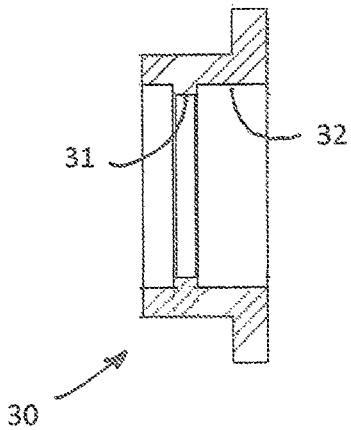
FIG. 7 is a longitudinal sectional view taken along line 7-7 in FIG. 6.

A third embodiment is indicated generally at 30 in FIGS. 6 and 7. This form of the invention is generally the same as that form shown in FIGS. 4 and 5 except that an annular rib 31 is on the inner surface of the bore 32, spaced inwardly from the inner end of the base member a distance calculated to engage the rib behind a button when the base member is fully engaged on the button. Otherwise, the materials and dimensions are essentially the same as in the previous embodiments.

Figure 8:
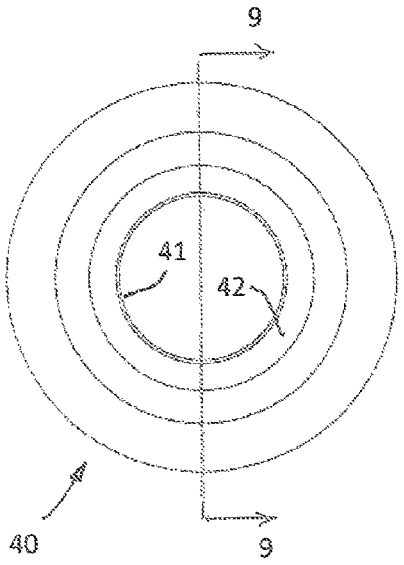
FIG. 8 is an end view in elevation of a fourth embodiment of the base member according to the invention, looking toward the back end of the base member, and wherein a tapered detent or lip is provided in the hollow bore at the end that is placed over a button.
Figure 9:
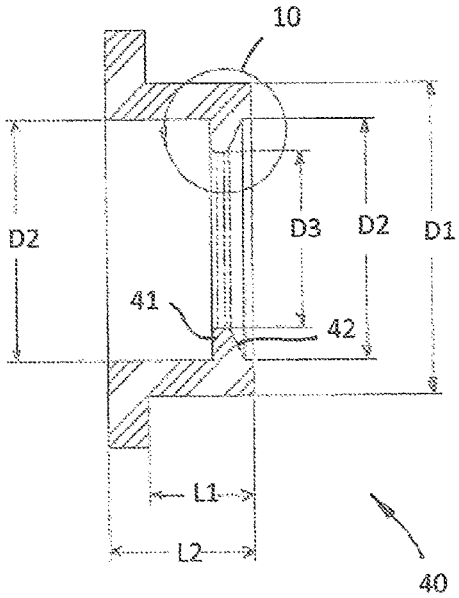
FIG. 9 is a longitudinal sectional view taken along line 9-9 in FIG. 8.
Figure 10:
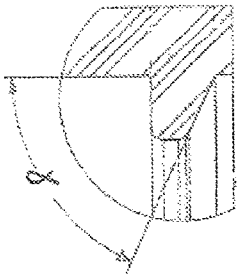
FIG. 10 is an enlarged fragmentary view of the circled area in FIG. 9.

A fourth embodiment is indicated generally at 40 in FIGS. 8, 9 and 10. This form of the invention is similar to that shown in FIGS. 6 and 7 but differs in that the detent comprises an inturned lip 41 formed in the bore at the end that receives the button, and this lip has a tapered surface 42 to facilitate its placement over a button. In one specific construction as an example of the invention, the cylindrical portion of the base member has an outer diameter D1 of 0.53 inch, an inner diameter D2 of 0.410 inch, and a length L1 of 0.18 inch. The base member has an overall length L2 of 0.25 inch. The lip 41 has an inner diameter D3 of 0.300 inch and the taper on the lip extends at an angle $\alpha$ of 65°.

Figure 11:
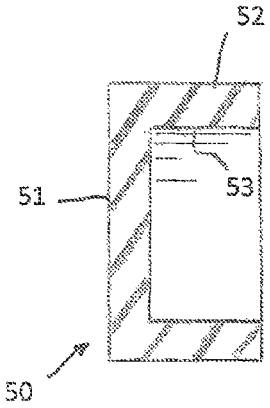
FIG. 11 is a longitudinal sectional view of a fifth embodiment of base member according to the invention, wherein the base member is generally cup-shaped.

A fifth embodiment is indicated generally at 50 in FIG. 11. The base member in this form of the invention is cup-shaped, with a constant outside diameter throughout its length, and comprises an end wall 51 and a cylindrical side wall 52 with a smooth bore 53 extending from the inner end of the side wall to the end wall. Otherwise, the materials and dimensions are essentially the same as in the previous embodiments.

Figure 12:
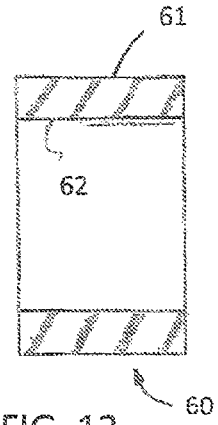
FIG. 12 is a longitudinal sectional view of a sixth embodiment of base member according to the invention, wherein the base member is an open-ended cylinder free of detents in its hollow bore.

A sixth embodiment of the invention is indicated generally at 60 in FIG. 12. This form of the invention comprises an open-ended cylinder 61 having a constant diameter outer surface and a smooth bore 62 extending through its length.

Figure 13:
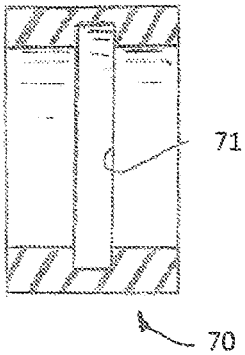
FIG. 13 is a longitudinal sectional view of a seventh embodiment of base member according to the invention, wherein the base member is an open-ended cylinder and has a recessed groove between the ends of its hollow bore to serve as a detent for receiving a button over which the base member is placed.

A seventh embodiment of the invention is indicated generally at 70 in FIG. 13. This form of the invention is generally the same as the FIG. 12 embodiment except that an annular channel 71 is formed in the bore between its ends for receiving the margin of a button inserted into the bore.

Figure 14:
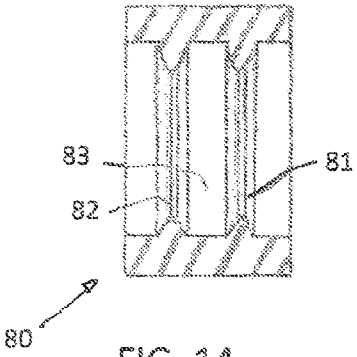
FIG. 14 is a longitudinal sectional view of an eighth embodiment of base member according to the invention, wherein the base member is an open-ended cylinder and has a pair of spaced rings in its hollow bore defining a space therebetween serving as a detent for a button over which the base member is placed.

FIG. 14 depicts an eighth embodiment 80 that is similar to the FIG. 12 embodiment except that a pair of rings 81 and 82 form a space or channel 83 between them to receive the margin of a button on which the base member is placed.

Figure 15:
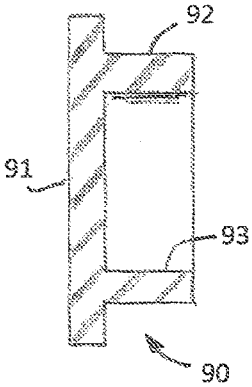
FIG. 15 is a longitudinal sectional view of a ninth embodiment of base member according to the invention, wherein the base member is generally T-shaped in longitudinal cross-section, with a smooth surfaced bore extending through the leg of the T and terminating at the head of the T.

FIG. 15 depicts a ninth embodiment that is similar to the embodiment shown in FIGS. 1-3, wherein the base member 90 is generally T-shaped in longitudinal section, with a disc-shaped end wall 91 and a cylindrically shaped leg 92. A central bore 93 extends through the leg and terminates at the end wall. The bore is smooth and of constant diameter throughout.

Figure 16:
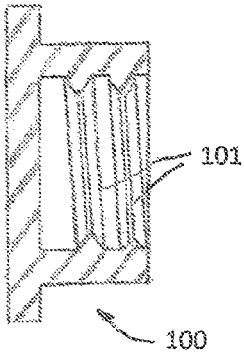
FIG. 16 is a longitudinal sectional view of a tenth embodiment of base member according to the invention, wherein the base member is generally T-shaped in longitudinal cross-section, with a screw thread formed in the bore extending through the leg of the T.

FIG. 16 depicts a tenth embodiment 100 that is similar to the embodiment shown in FIG. 15, but the surface of the bore is threaded at 101 so that it can be threaded onto a button.

Figure 17:
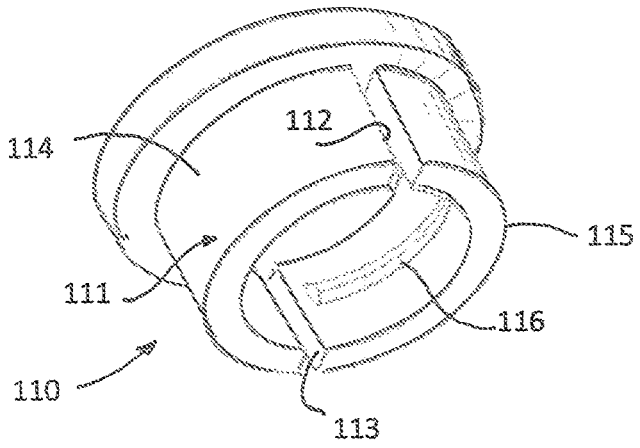
FIG. 17 is a bottom isometric view of an eleventh embodiment of the invention, looking toward the end that is placed over a button, wherein the base member is made of a more rigid material and is longitudinally slit to enable it to spring open to receive and grip a button.

The base member 110 in the eleventh embodiment shown in FIG. 17 is shaped similarly to the base member shown in FIG. 15, but the cylindrically shaped leg 111 is slit longitudinally on at least one side. In the particular example shown slits 112 and 113 are formed on each of two opposite sides, forming opposed segments 114 and 115 that are separate from one another. The base member in this form of the invention is made of a more rigid material, such as plastic, than is used in the previous embodiments and the slits are necessary to enable the segments to move away from one another to receive a button. Annular ribs are formed on the inner surface of at least one of the segments, and preferably on both, to ensure secure attachment of this form of base member to a button. Only one rib 116 is shown in this view.

In all forms of the invention the base member has a snug friction fit on the button and some suction is produced by the closed bore, whether the bore is closed by a decorative member fixed on the outer end of that form of base member having a bore extending completely therethrough or by an end wall on the base member.

A variety of decorative members can be attached to base members to produce decorative covers having various themes, whether whimsical or formal in nature, and different decorative covers can be applied to buttons or studs or similar objects to produce desired results and can be readily removed and replaced with other decorative covers to produce different results.

What is claimed is:

1. A replaceable decorative cover for interchangeable attachment to a generally flat disc-shaped button to change the decorative or thematic appearance of the button, wherein the decorative cover comprises:

a base member having a cylindrical part with a hollow bore therein extending through at least one end of said base member, said bore having a length and a diameter, said diameter being approximately twice as great as said length and being slightly smaller than the diameter of the button to which the base member is to be attached, and said base member being made of an elastomeric material having a durometer to enable an outer peripheral margin of the button on which the base member is engaged to deform and press into an inner surface of said bore to frictionally retain said base member on the button against inadvertent removal but permit it to be removed when desired;

a detent in said hollow bore at said one end, said detent comprising an annular lip projecting into said bore for engaging behind a peripheral marginal edge of the button when the base member is pressed onto the button to retain said base member on the button against inadvertent removal but permit it to be removed when desired, said annular lip being tapered on a surface thereof facing toward said one end of said bore to facilitate pressing of said base member onto the button; and a decorative part permanently attached to an outer end of said base member opposite said one end, whereby said base member and the decorative part may be removed from the button and replaced with another base member and associated different decorative part to form a different decorative cover on said button.

2. The decorative cover as claimed in claim 1, wherein:

said base member is made of an elastomeric material having a durometer from about 55 Shore A to about 65 Shore A.

3. The decorative cover as claimed in claim 2, wherein:

said base member is made of Buna N rubber.

4. The decorative cover as claimed in claim 2, wherein:

said base member is made of silicone.

5. The decorative cover as claimed in claim 1, wherein:

a radially outwardly extending flange is on said outer end of said base member.

6. An interchangeable replaceable decorative cover removably attached to a generally flat disc-shaped button to change the decorative or thematic appearance of the button, wherein the decorative cover comprises:

a base member made of an elastomeric material and having a cylindrical part with a hollow bore therein extending through at least one end of the base member, said bore having a length and a diameter, said diameter being approximately twice as great as said length and being slightly smaller than the diameter of the button so that an outer peripheral margin of the button on which the base member is engaged deforms and presses into an inner surface of said bore to frictionally retain said base member on the button against inadvertent removal but permit it to be removed when desired; a detent in said hollow bore at said one end, said detent comprising an annular lip projecting into said bore and engaging behind a peripheral marginal edge of the button, said annular lip being tapered on a surface, thereof facing toward said one end of said bore to facilitate pressing of said base member onto the button; and a decorative part permanently attached to an outer end of said base member opposite said one end, whereby said base member and the decorative part may be removed from the button and replaced with another base member and associated different decorative part to form a different decorative cover on said button.

7. The decorative cover as claimed in claim 6, wherein:

a radially outwardly extending flange is on said outer end of said base member.

* * * * *